US007762831B2

(12) United States Patent
Lin

(10) Patent No.: US 7,762,831 B2
(45) Date of Patent: Jul. 27, 2010

(54) PROTECTION SYSTEM AND SOCKET THEREOF

(75) Inventor: Tsung-Yu Lin, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/471,484

(22) Filed: May 26, 2009

(65) Prior Publication Data

US 2009/0305545 A1 Dec. 10, 2009

(30) Foreign Application Priority Data

Jun. 10, 2008 (CN) ..... 2008 1 0302075

(51) Int. Cl.
*H01R 13/62* (2006.01)

(52) U.S. Cl. ..... 439/373; 439/160; 439/157

(58) Field of Classification Search ..... 439/373, 439/372, 160, 157
See application file for complete search history.

(56) References Cited

U.S. PATENT DOCUMENTS

| | | | | | |
|---|---|---|---|---|---|
| 1,947,634 | A * | 2/1934 | Anderson | 200/50.29 |
| 2,399,644 | A * | 5/1946 | Lachance | 439/362 |
| 2,659,059 | A * | 11/1953 | Johnson | 439/373 |
| 4,045,108 | A * | 8/1977 | Olsen | 439/368 |
| 4,070,081 | A * | 1/1978 | Takahashi | 439/372 |
| 4,109,095 | A * | 8/1978 | Kling et al. | 174/67 |
| 4,534,608 | A * | 8/1985 | Scott et al. | 439/345 |
| 4,752,236 | A * | 6/1988 | Carmichael et al. | 439/372 |
| 5,080,598 | A * | 1/1992 | Shotey | 439/147 |
| 5,183,404 | A * | 2/1993 | Aldous et al. | 439/55 |
| 5,348,495 | A * | 9/1994 | Kasden | 439/371 |
| 5,593,313 | A * | 1/1997 | Shibuya et al. | 439/373 |
| 5,655,924 | A * | 8/1997 | Cross et al. | 439/373 |
| 5,882,227 | A * | 3/1999 | Neidich | 439/607.1 |
| 5,938,468 | A * | 8/1999 | Lin | 439/372 |
| 5,997,342 | A * | 12/1999 | Suzuki | 439/489 |
| 6,475,017 | B1 * | 11/2002 | Wu | 439/372 |
| 6,739,896 | B2 * | 5/2004 | Sivertsen | 439/371 |
| 6,851,964 | B2 * | 2/2005 | Miller | 439/372 |
| 7,014,493 | B1 * | 3/2006 | Battard | 439/373 |
| 7,083,462 | B1 * | 8/2006 | Chen et al. | 439/372 |
| 7,104,830 | B1 * | 9/2006 | Diaz | 439/372 |
| 7,429,701 | B1 * | 9/2008 | Kushnir et al. | 174/53 |
| 2008/0207041 | A1 * | 8/2008 | Koessler | 439/372 |

* cited by examiner

*Primary Examiner*—T C Patel
*Assistant Examiner*—Vladimir Imas
(74) *Attorney, Agent, or Firm*—Raymond J. Chew

(57) ABSTRACT

A socket, comprising at least two insertion holes and a clasp device rotatably fastened on the socket. The clasp device comprises a clasp body, a cover, a bottom plate, and a connection body. The cover is positioned relative to the bottom plate, and the connection body is positioned between the cover and the bottom plate, wherein the cover, the bottom plate and the connection body define a receiving cavity.

12 Claims, 3 Drawing Sheets

PROTECTION SYSTEM AND SOCKET THEREOF

BACKGROUND

1. Technical Field

The disclosure is related to a plug and a socket, and particularly, to a protection device for a plug and a corresponding socket.

2. Description of Related Art

A plug is used to plug into a socket to provide electrical power to an electronic device. However, plugs may easily dislodge from sockets, and are easily exposed to environmental contamination. Furthermore, circuit interference, such as a short circuit or an open circuit may easily occur that may damage the electronic devices. Thus, what is needed is a protection device for a plug and a socket that secure the plug not to dislodge from the socket.

DETAILED DESCRIPTION

Figure 1:
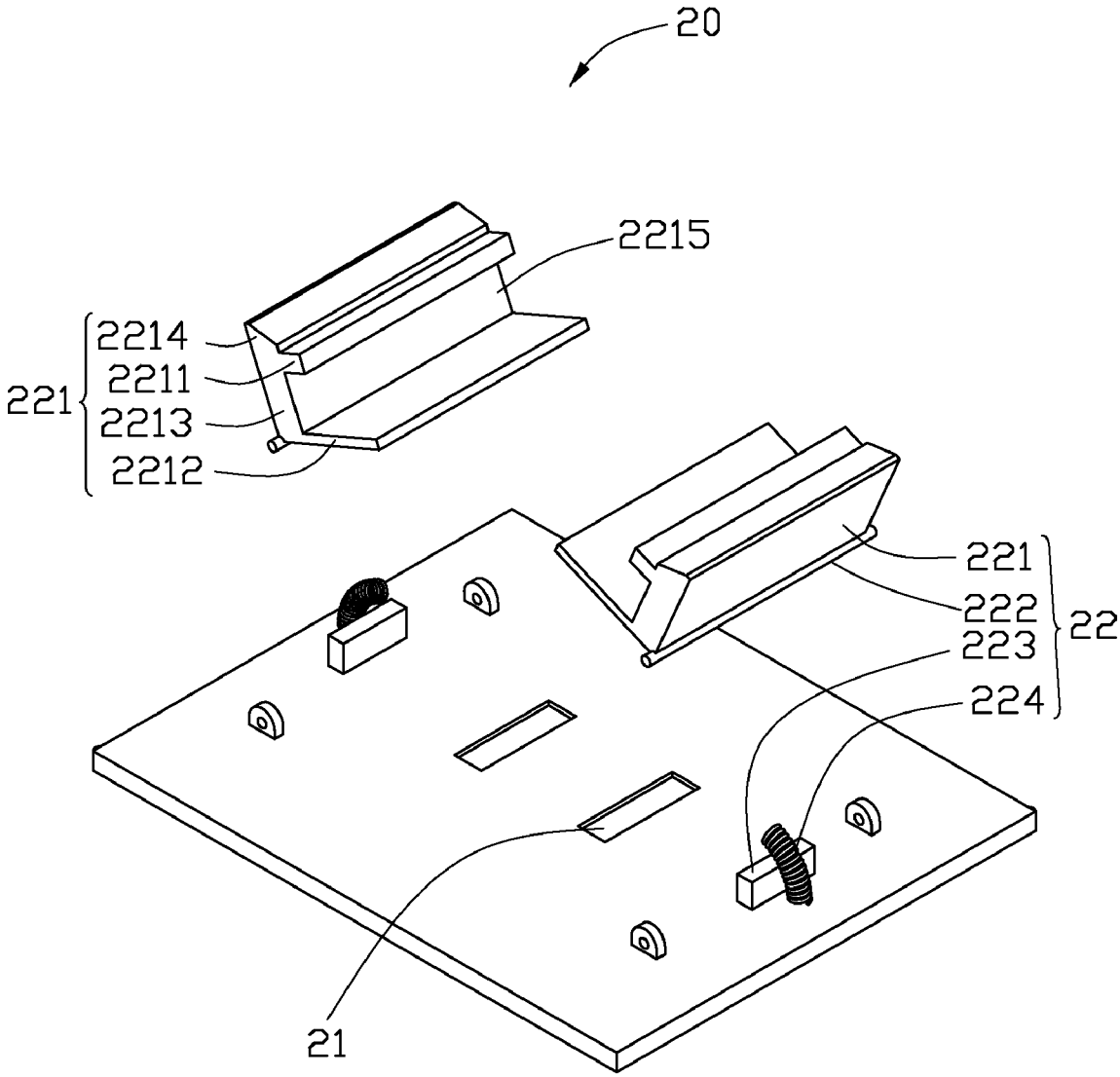
FIG. 1 is an exploded diagram of a plug and socket of a protection system as disclosed.
Figure 2:
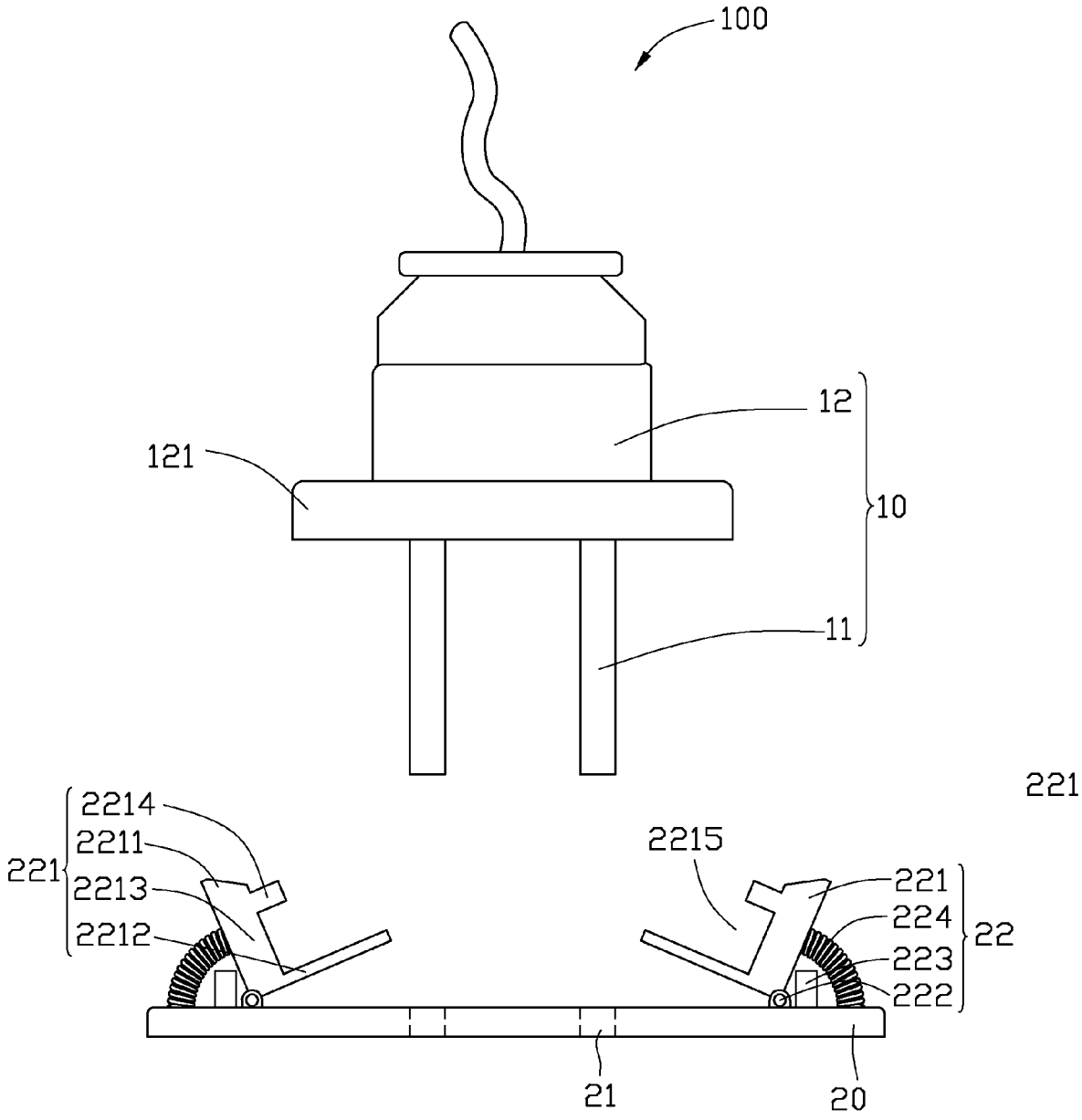
FIG. 2 shows a socket as disclosed, showing the socket and a plug in an unplugged state.
Figure 3:
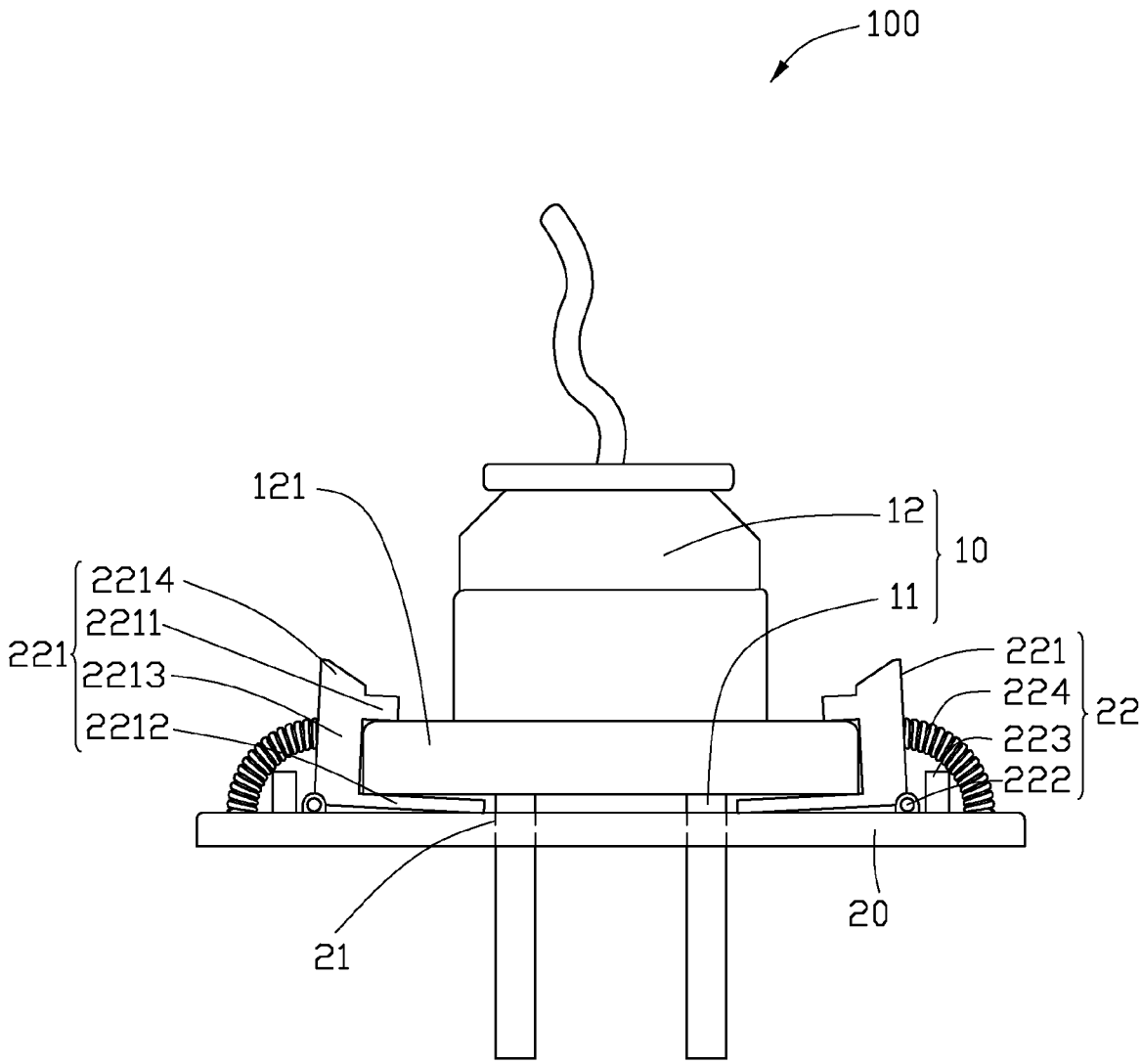
FIG. 3 shows a socket as disclosed, showing the socket and a plug in a plugged state.

FIG. 1-3 show a protection device for a plug 10 and a socket 20 as disclosed. The plug 10 comprises two parallel pins 11 and a body 12. A flange 121 is provided in proximity to one end of the pin 11, which can be rectangular, annular, or other shape. In this embodiment, the flange is shown as a rectangle.

The socket 20 includes a base plate 200 defining two insertion holes 21 therein and further includes two clasp devices 22 rotatably fastened to the base plate 200 and located outside the insertion holes 21. The number of insertion holes 21 corresponds to or exceeds the number of pins 11. The clasp device 22 comprises a clasp body 221, a rotation axle 222, a fastening post 223 and a spring 224.

The clasp body 221 comprises a cover 2211, a bottom plate 2212, a connection body 2213 located between and connecting the cover 2211 and the bottom plate 2212. The cover 2211 and the bottom plate 2212 are substantially parallel. In this embodiment, the connection body 2213 extends out of the cover 2211, and the extended portion 2216 of the connection body 2213 comprises an inclined surface 2214 relative to an extending direction of the connection body 2213. The inclined surface 2214 and the extending direction of the connection body 2213 define an acute angle. The cover 2211, the bottom plate 2212 and the connection body 2213 define a receiving cavity 2215. When the pin 11 is received in the insertion holes 21, the clasp body 221 clasps the flange 121, and the flange 121 is partially received into the receiving cavity 2215.

The rotation axle 222 is rotatably fastened to the socket 20, and connected to the connection body 2213 and the bottom plate 2212. A post 223 is provided on the socket 20, in proximity to one side of the rotation axle 222 away from the plug 21. A spring 224 is configured for elevating the plug, wherein one end of the spring 224 is connected to the socket 20, and another end is connected to the clasp body 221. When the plug 10 is not received in the socket 20, the clasp body 221 is supported on the fastening post 223 by the retention force of the spring 224, and an angle is formed between the bottom plate and the socket 20 through the position of the post 223.

The flange 121 is received in the cavity 2215 and secured by the cover 2211 and the bottom plate 2212. Downward pressure on the inclined plane 2214 withdraws the plug 10, and the rotation axle 222 rotates to impel the clasp body 221 to elevate the flange 121*p*, and the plug 10 can be withdrawn.

The flange 121 is securely fastened in the receiving cavity 2215 by at least one clasp body 221 when the pin 11 of the plug 10 is received in the insertion holes 21.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A socket for securing a plug, the plug comprising a flange and two pins connected to the flange, the socket comprising:

a base plate defining two insertion holes therein, two clasp devices each rotatably fastened to the base plate, each clasp device comprising a spring, a cover, a bottom plate, and a connection body, the connection body being located between and connecting the cover and the bottom plate, the cover being substantially parallel to the bottom plate, the cover, the bottom plate and the connection body cooperatively defining a receiving cavity, the two springs connecting the respective clasp devices with the base plate, the two clasp devices selectively operating one of in an opened position, where the plug is detached from the two clasp devices and where the springs have a first length, and in a closed position, where the flange is partially secured in the two receiving cavities with the pins being received in the respective holes and where the springs are each extended to have a second length, the extended springs thus applying a tensile force on the two respective clasp devices such that the cover and the bottom plate both abut against the flange.

2. The socket of claim 1, wherein each clasp device is rotatably fastened to the base plate with a rotation axle thereof located at an intersection of the connection body and the bottom plate, the two bottom plates each being inclined relative to the base plate when the springs are in the first length, and the bottom plates abut against the base plate when the springs are in the second length.

3. The socket of claim 2, wherein each spring is connected to the connection body and the base plate, and each clasp device further comprises a fastening post positioned on the base plate at a side of the connection body facing away from the holes, and the two fastening posts are configured for abutting against the respective connection bodies when the two springs are in the first length and apply a tensile force on the respective clasp devices, the applied tensile force maintaining the bottom plates each in a position inclined relative to the base plate.

4. A protection system comprising:

a plug comprising a flange and two pins connected to the flange;

a socket, the socket comprising:

a base plate defining two insertion holes therein, and two clasp devices each rotatably fastened to the base plate, each clasp device comprising a spring, a cover, a bottom plate, and a connection body, the connection body being located between and connecting the cover and the bottom plate, the cover being substantially parallel to the bottom plate, the cover, the bottom plate and the connection body cooperatively defining a receiving cavity, the two springs connecting the respective clasp devices with the base plate, the two clasp devices selectively operating one of in an opened position, where the plug is detached from the two clasp devices and where the springs have a first length, and in a closed position, where the flange is partially secured in the two receiving cavities with the pins being received in the respective holes and where the springs each are extended to have a second length, the extended springs thus applying a tensile force on the two respective clasp devices such that the cover and the bottom plate both abut against the flange.

5. The device of claim 4, wherein the flange is rectangularly-shaped.

6. The device of claim 4, wherein the flange is shaped as a ring.

7. The protection system of claim 4, wherein a width of the bottom plate relative to the connection body is greater than that of the cover.

8. The protection system of claim 4, wherein the connection body extends out of the cover, and the extended portion of the connection body comprises an inclined surface relative to an extending direction of the connection body, the inclined surface and the extending direction of the connection body define an acute angle.

9. The protection system of claim 4, wherein each clasp device is rotatably fastened to the base plate with a rotation axle thereof located at an intersection of the connection body and the bottom plate, the two bottom plates each are inclined relative to the base plate when the springs are in the first length, and the bottom plates abut against the base plate when the springs are in the second length.

10. The protection system of claim 9, wherein each spring is connected to the connection body and the base plate, and each clasp device further comprises a fastening post positioned on the base plate at a side of the connection body facing away from the holes, and the two fastening posts are configured for abutting against the respective connection bodies when the two springs are in the first length and apply a tensile force on the respective clasp devices, the bottom plates each thus being maintained in a position inclined relative to the base plate due to the applied tensile force.

11. The socket of claim 1, wherein the connection body extends out of the cover, and the extended portion of the connection body comprises an inclined surface relative to an extending direction of the connection body, the inclined surface and the extending direction of the connection body defining an acute angle.

12. The socket of claim 1, wherein a width of the bottom plate relative to the connection body is greater than that of the cover.

* * * * *